United States Patent [19]

Hoshino et al.

[11] Patent Number: 4,680,022

[45] Date of Patent: Jul. 14, 1987

[54] TOY LINKAGE

[75] Inventors: Shiro Hoshino; Bonpei Fujino, both of Tokyo, Japan

[73] Assignee: Tomy Kogyo Co. Inc., Tokyo, Japan

[21] Appl. No.: 581,424

[22] Filed: Feb. 17, 1984

[30] Foreign Application Priority Data

Feb. 26, 1983 [JP] Japan ..... 58-27960[U]

[51] Int. Cl.[4] ..... A63H 11/20

[52] U.S. Cl. ..... 446/487; 446/356; 446/278; 74/469; 74/96; 414/1; 901/28; 180/8.6

[58] Field of Search ..... 446/487, 278, 368, 356, 446/355, 376; 74/97, 469, 96, 521; 901/28, 39; 414/1, 738; 180/8.1, 8.6

[56] References Cited

U.S. PATENT DOCUMENTS

| | | | |
|---|---|---|---|
| 1,540,247 | 6/1925 | Bowman | 74/97 |
| 2,618,713 | 11/1952 | Blinn | 74/96 X |
| 2,638,709 | 5/1953 | Mason | 446/356 |
| 2,667,719 | 2/1954 | Edwardson | 446/355 |
| 3,580,099 | 5/1971 | Mosher | 74/469 |
| 3,624,957 | 12/1971 | Good | 446/425 |

*Primary Examiner*—Mickey Yu
*Attorney, Agent, or Firm*—Herb Boswell

[57] ABSTRACT

A toy is constructed to include two unique linkages with the first linkage including a series of links located in a sequential array with each link pivotally connected to its next immediate adjacent neighbor and every other link operatively connected such that each link can pivot with respect to its neighbor and motion of a link pivotally connected to one side of a link is communicated to the link pivotally connected to the other side of that same link. This allows the linkage to propagate motion along the totality of the sequence in response to movement of any one link. The second linkage includes a first member which is pivotally connected to a rotating crank pin and connected at its upper end to a second lever which is pivotally connected to a body on which the crank pin rotates. A third member formed as a bell crank is pivotally connected at the junction of its arms to the other end of the first member and pivotally connected at the end of one of its arms to a fourth member which is also pivotally connected to the body. Movement of the crank pin causes movement of the first member which is transmitted to the remainder of the members with the lower end of the first member moving in a first small orbit and this motion being communicated to the lower end of the third member to move it in a larger orbit.

6 Claims, 7 Drawing Figures

68
76
64
52
72
30
28
32
24
18
20
46
100
98
16
106
104
114
26
94
92
112
48
40
96
88
86
60
50
58
108
116
62
86
36
38
44
22
54
56
70
42
34
66
74

114
100
96
94
102
98

84
80
46
92
90
88
82
86
54
48
86
56

TOY LINKAGE

BACKGROUND OF THE INVENTION

This invention is directed to a linkage for use in toys which allows for novel movement of the toy. Various elements of the linkage are articulated with respect to one another so as to move with respect to one another and further including other elements connecting the articulated elements so as to propagate movement among the elements.

Many toys are known which utilize a series of component parts which are attached together one to the other in a line or sequence. Included in this category would be a variety of toys ranging from infant pull toys having a line of jointed parts to more sophisticated toys just such as that described in U.S. Pat. No. 2,809,467. The toy of that patent has a series of joined blocks with fabric or other flexible connectors which allows for one block progressed along the sequence in a seemly "magically manner". In between these two extremes are other jointed toys such as the articulated characters and vehicles shown in U.S. Pat. Nos. 2,751,643 and 2,852,887 and the articulated construction toy shown in U.S. Pat. No. 2,496,810.

All of the above referred to articulated toys have parts which are joined together in a sequence. In all except the U.S. Pat. No. 2,809,467 the sequence is a fixed sequence. For those toys having a fixed sequence, however, the articulated structure simply pivotally joins one part to a second part. While this allows for movement of the individual articulated parts with respect to one another, if the parts are individually moved by an outside influence it does not allow for propagation of movement along the totality of the articulated structure to all of the parts.

Nature in designing the skeletal muscle system of many creatures has provided a unique articulated structure which allows for complex bending movements. This is very evident in reviewing the movements of a variety of the diversed animal structures such as snakes for their complex wiggling and the like and the legs of the larger land forms which have a unique movement about their knees and elbows. Nature achieves these complex articulated movements utilizing a support system formed of bones which are articulated one to the other one and which are connected by and moved by a complex array of muscles. In developing an articulated structure for use in toys, the toy designer is quite limited since the design cannot use a plurality of muscles structures in the same manner as nature does.

BRIEF DESCRIPTION OF THE INVENTION

In view of the above, it is considered evident that there exists a need for new and improved articulated linkages for use in toys. It is therefore a broad object of this invention to provide such new and improved articulated linkages. It is a further object of this invention to provide linkages which are capable of unique movements which are seemingly complex but which in fact are achieved with structures having a sparsity of components. It is a further object of this invention to provide articulated linkages which are capable of being utilized with toys which have seemnly life-like movements because of the incorporation of these linkages in the toys. It is a further object of this invention to provide linkages which because of their engineering principles, are both economically manufactured yet simple in construction and operation such that a child playing with the toys can enjoy many hours of fun over a long and useful lifetime of the toy.

These and other objects as will be evident from the remainder of this specification are achieved in a first embodiment of the invention wherein a plurality of at last three links are located one adjacent to the next in a linear sequence with a link at each end of the sequence located adjacent to one other link and each link in the interior of the sequence having a link adjacent to it on one side and a further link adjacent to it on the other side; connecting means rotatability connecting each two adjacent links, a portion of said connecting means located on one of said two adjacent links and a further portion of said connecting means located on the other of said two adjacent links; a motion transfer means operatively associating each two links which are on the respective side of and are connected to a third central link located between said respective two links, a portion of said motion transfer means located on one of said respective two links and a further portion located on the other of said respective two links, said motion transfer means for transferring motion of one of said respective two links with respect to said third link to the other of said two links.

Further, these objects are achieved in a second embodiment of the invention wherein a linkage for a moveable toy having a body and a motor located in said body, said linkage comprising a crank operatively associated with said motor so as to be rotated by said motor said crank including a crank pin which moves in a circular pathway in response to rotation of said crank; a first member having ends and including connecting means located between said ends, said first member pivotally mounted to said crank pin about said connecting means; a second member having at last one end and a second member connecting means, said second member pivotally mounted to said body about said second member connecting means, said at least one end of said second member pivotally connecting to one of the ends of said first member whereby rotation of said crank is transferred to said first member to move said first member and in turn said first member rotating said second member about said second member connecting means.

In the first embodiment of the invention a plurality of articulated links are preferredly joined utilizing a journal and bearing connection such that each link is pivotally connected to one neighbor if it is an end link or to two neighbors, one on each of its two respective sides, if it is an interior link. The motion transfer means connects the links in essentially two series, this being an odd series wherein links 1, 3, 5 and etc. are connected together and an even series wherein links 2, 4, 6, 8 and etc. are connected together. In this way motion of link 1 with respect to link 2 is to conveyed to link 3, moving link 3 with respect to link 2, and motion of link 2 with respect to link 3 is conveyed to link 4 moving link 4 with respect to link 3, etc. etc. for the remainder of the link from the first to the last link.

In the first embodiment of the invention by including an activation member on a link which is immediately adjacent to one of the end links and fixing either the activation member or that end link and moving the other of the activation link or that end link, motion can be propagated along the articulated series of links from the one end of the series of links to the other end.

By placing the motion transfer means members in different positions with respect to the journal and bearing connectors a variety of motions can be achieved with the articulated linkage. The articulated linkage can be made to curve in compound ways in much the same way as a snake does as it moves and slithers.

In the second embodiment of the invention the linkage described therein can be advantageous utilized to provide a propulsion mechanism for moving a toy wherein the toy moves in a very animated like manner which mimiks both a knee and hip motion of a four-legged animal. This can be advantageously accomplished by including a third member attaching to the first member with a fourth member then pivotally connecting between the third member and the body of the toy. If the first member is held in essentially a vertical orientation, movement of the third member with respect to the first member is much like movement of a lower leg with respect to a upper leg of a four-legged animal.

BRIEF DESCRIPTION OF THE DRAWINGS

This invention will be better understood when taken in conjunction with the drawings wherein.

Figure 1:
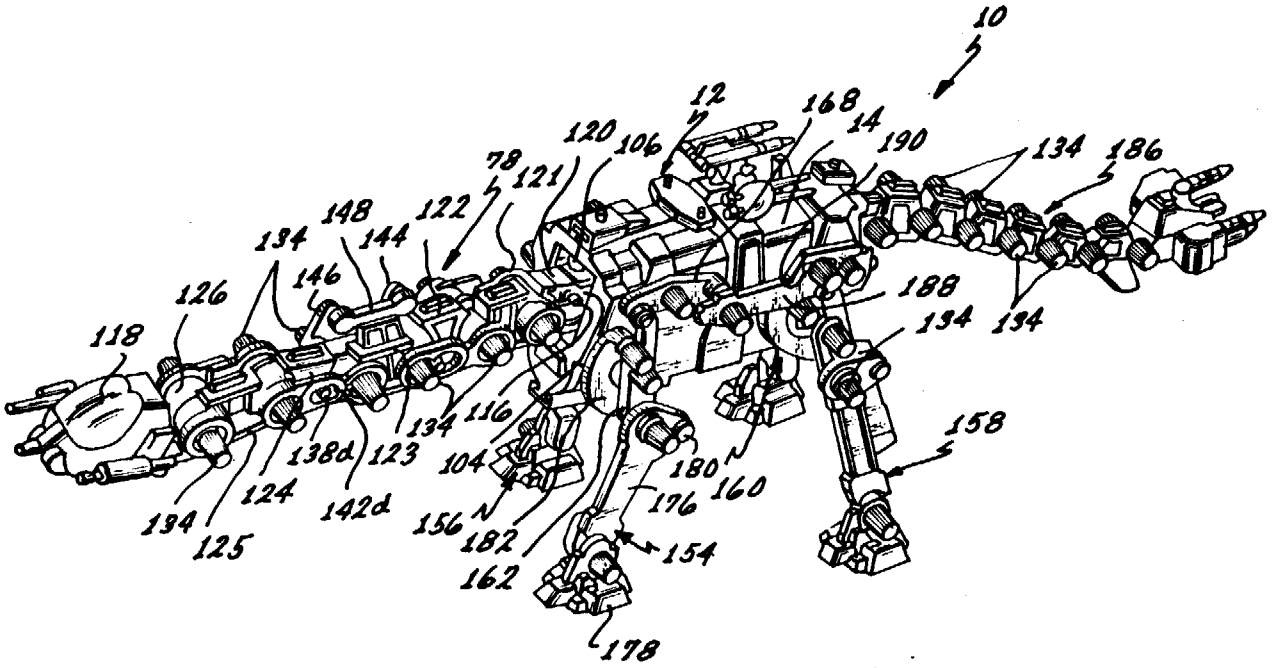
FIG. 1 is an isometric view of a toy incorporating both embodiments of this invention.
Figure 2:
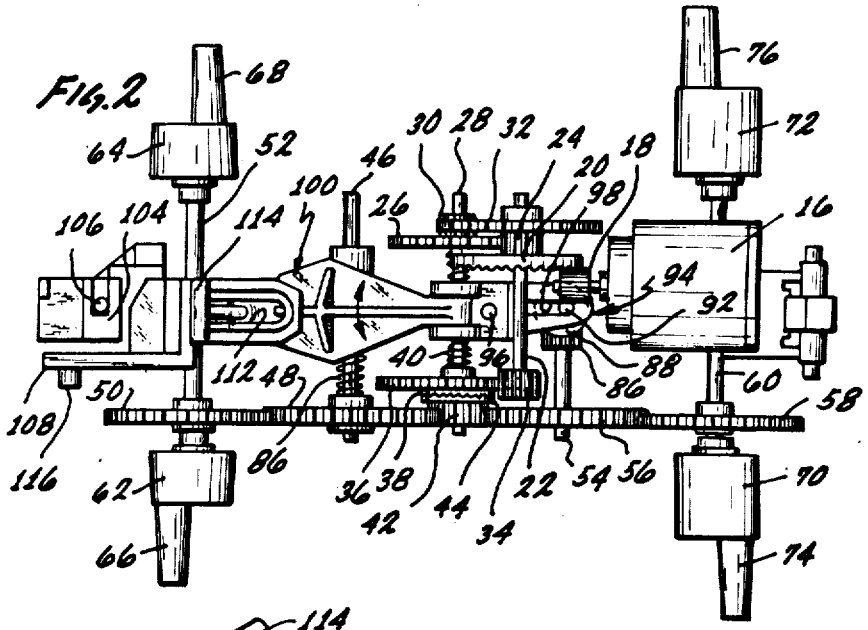
FIG. 2 is a plan view of the interior of the body of the toy showing components located therein which are utilized in providing movement of the toy.

The invention described in this specification and shown in the drawing utilizes certain principles and/or concepts as are set forth in the claims appended to this specification. Those skilled in the toy arts will realize that these principles and/or concepts are capable of being utilized in a variety of embodiments which differ from the exact embodiments utilized for illustrative purposes herein. For this reason, this invention is not be construed as being limited to the exact illustrative embodiments but is to be construed as to being limited by the claims.

DETAILED DESCRIPTION OF THE INVENTION

In the figures there is shown a toy 10 which utilizes both a first and second type linkage. One of the linkages is utilized in each of the four legs and although the legs have minor design differences because of their left-right or front-back position the same system of levers and the like are utilized in their construction. The other linkage is employed in the neck which connects the head like portion of the toy 10 to the remainder of the body.

Both of the linkages are powered by the same propulsion mechanism which is shown in views 2,3, and 4. The propulsion mechanism is located in the body portion 12 of the toy 10. An outside shell 14 is constructed to include a plurality of different design features thereon which carries as its theme a combination of a mechanical mechanism and a animal type body. Located within the shell 14 is a motor 16 which is powered by a series of batteries not separately numbered or shown which are located in the belly portion of the body 12. The motor 16 drives a small pinon 18 which meshes with a crown gear 20. The crown 20 is free wheeling about an axle 22. Integrally formed with the crown gear 20 is a small pinon 24 which is also free wheeling on the axle 22.

The pinon 24 meshes with a spur gear 26 which is free wheeling on an axle 28. Integrally formed on the spur gear 26 is a pinon 30. A spur gear 32 which is fixed to the axle 22 meshes with the pinon 30 such that rotation of the crown gear 20 on the axle 22 is communicated to the spur gear 32 via gears 24, 26 and 30 to rotate the gear 32 and the axle 22.

The axle 22 also carries a pinon 34 fixed to it such that it is rotated by the axle 22. The pinon 34 meshes with a spur gear 36 which is integrally formed with reentrant gear 38. Both of these gears are carried on axle 28 and are free wheeling on this axle. A small spring 40 located around the axle 28 maintains the placement of the spur gear 36 and the previously described spur gear 26 on the axle 28. A pinon 42 fixed to the axle 28 includes a reentrant gear 44 integrally formed with it. The spring 40 about the axle 28 biases the reentrant gear 38 toward reentrant gear 44 such that it meshes with the reentrant gear 44 to transfer motion from the spur gear 36 to the pinon 42 during normal operation. If for one reason or the other something in the gear train on either side of the reentrant gears 38 or 44 is fixed and the other side of the gear train rotates, the reentrant gears 38 and 44 slip with respect to one another by compression of the spring 40 toward to spur gear 26. This serves as a clutch mechanism to protect all of the gears within the gear train.

An axle 46 located in front of axle 28 carries a large spur gear 48 fixed to it which meshes with the pinon 42. A further spur gear 50 carried on an axle 52 meshes with the spur gear 48 with the gear 50 fixed to the axle 52 such that ultimately rotation of the pinon 42 is transmitted to the axle 52 to rotate the same.

An axle 54 is located behind axle 28 and carries a spur gear 56 fixly attached to it with the spur gear 56 meshing with the pinon 42. A further spur gear 58 fixed to axle 60 meshes with the spur gear 56 such that rotation of the pinon 42 is also transferred to the axle 60. Because of the gear train previously described wherein rotation of the pinon 42 is transferred via two gears to the axle 52 and via two different gears to the axle 60 the axles 52 and 60 rotate in the same direction.

The axle 52 carries a left front crank disc 62 fixed to it on the left side and a right front crank disc 64 fixed to it on the right side. The crank disc 62 carries a crank pin 66 integrally formed with it and the crank disc 64 carries a like crank pin 68. The crank pins 66 and 68 are offset with respect to one another such that they are 180° out of phase. In a like manner the rear axle 60 carries a left rear crank disc 70 and a right rear crank disc 72 having respective crank pins 74 and 76 formed thereon which are also 180° out of phase with respect to one another. On any particular side, say the left side, the front crank pin 66 is positioned 180° out of phase with the rear crank pin 74 and likewise on the right side the front crank pin 68 is 180° out of phase with the front crank pin 76.

Because of the front-rear phase difference on either side, say for example on the left side, wherein left front crank pin 66 is out of phase with respect with the left rear crank pin 74 movement of the left front leg will be out of phase with respect to movement of the corresponding back leg. Likewise, because of the left-right phase difference, for example, along the front axle 52, movement of the front left leg will be out of phase with respect to movement of the right front leg. The same phase shift exists between the front and rear legs on the right side and the left and right leg on the back axle 60.

Figure 4:
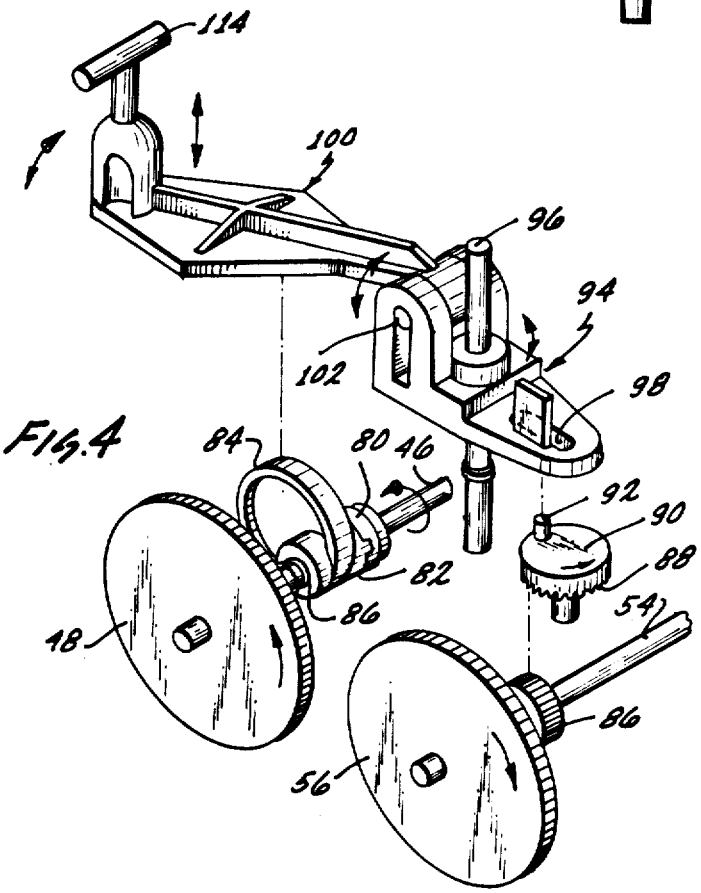
FIG. 4 is an isometric exploded view of certain of the components seen in FIG. 2.

The neck 78 is capable of both side to side motion and up and down motion. The up and down motion is very unique because of the articulated linkage of the neck 78 as explained below. Both of these motions, however, are simultaneously powered by the rotary output of the motor 16. The axle 46 as best seen in FIG. 4 has a small reentrant gear 80 fixedly attached to it at about midpoint between its ends. A second reentrant gear 82 is integrally formed with a cam 84 with both of these free wheeling on the axle 46. A spring 86 located around portions of the axle 46 biases the reentrant gear 82 away from the spur gear 48 such that it meshes with the reentrant gear 80. In this way rotation of the axle 46 is transferred via the reentrant gear 80 to the reentrant gear 82 and to the cam 84. Rotation of the axle 46 thus indirectly rotates the cam 84 through the clutch mechanism formed by the gears 80 and 82.

The axle 54 which carries the spur gear 56 also carries a small pinon 86 fixedly attached to it such that the pinon 86 is rotated in conjunction with the rotation of the axle 54. A crown gear 88 formed as a part of crank disc 90 meshes with the pinon 86 such that a crank pin 92 is rotated in response to rotation of the axle 54. The cam 84 is utilized to affect the up-down motion of the neck 78 whereas the crank disc 90 and pin 92, are utilized to affect the side to side motion of the neck 78.

A member 94 is fixed to an axle 96 such that it can rotate about the axle 96. The member 94 includes a slot 98 which engages the crank pin 92 and as the crank pin 92 rotates on crank disc 90, the pin 92 rides in the slot 98 to cause the member 94 to oscillate first clockwise a few degrees and then counter-clockwise a like number of degrees about the axle 96. A second member 100 is pivotally mounted to the member 94 via an axle 102 which is mounted to the member 94. The member 100 oscillates backward and forward in direct response to the oscillation of the member 94 under the influence of rotation of the crank pin 92.

The member 100, however, can move up and down with respect to the member 94 about the axle 102. The member 100 rests on top of the cam 84 and as the cam 84 rotates in response to the rotation of the axle 46, the member 100 is oscillated up and down. Thus, the member 100 oscillates both side to side with respect to movement imparted to it by the member 94 as well as up and down with respect to the movement imparted to it by the cam 84.

A neck foundation member 104 is pivotally mounted about an axle 106 to the body shell 14. This allows the foundation member 104 to move side to side. The neck 78 as hereinafter explained links to the foundation member 104. The foundation member 104 carries a vertical movement transfer member 108 which is hinged to the member 104 via a pin 110. The transfer member 108 is essentially a first class lever having a slot 112 on one of its arm which fits over a T-bar 114 which is formed on the member 100. A small boss 116 is located on the other arm of the member 108 and interacts with a portion of the neck 78 as explained below to move the neck 78 up and down in a complex motion.

As the member 94 pivots about its axle 96, this pivoting motion is communicated via the member 100 to the T-bar 114. The T-bar 114 then interacts through the transfer member 108 to rotate the foundation member 104 about its axle 106. This is done simultaneously with upward and downward movement of the member 100 rocking the transfer member 108 about its pin 110 in an upward and downward motion.

Figures 3, 5:
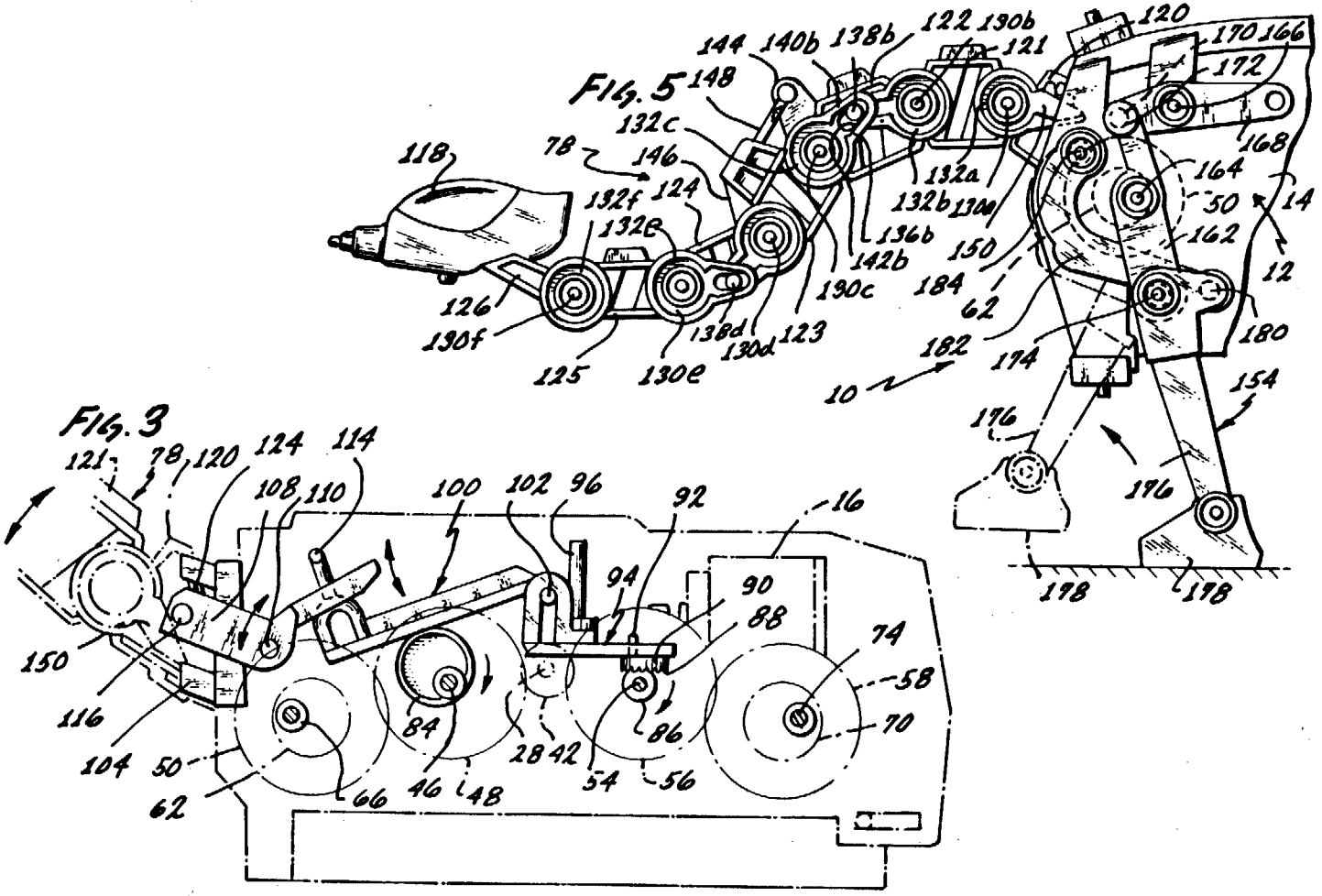
FIG. 3 is a side elevational view of the components seen in FIG. 2.
FIG. 5 is a side elevational view of the forward most portion of the toy seen in FIG. 1 showing certain components located therein in a first spatial configuration.

The neck 78 is made up of a series of individual links which are connected so as to be articulatable with respect to one another and are further connected such that movement to one link is propagated to the remainder of the links. At the end of the neck 78 is a head unit 118 which is moved in response to movement of the neck 78. Movement of the neck 78 is a unique movement as can be ascertained in reviewing FIGS. 5 and 6. In FIG. 5 the head 118 is lowered with the neck 78 in an essentially "S" shape, curving first counter-clockwise as one moves from the body 12 toward the head 118 and then clockwise. In response to movement of the member 100, the neck then re-orients itself to the orientation seen in FIG. 6 where again moving from the body 12 toward the head 118, the neck is now bent first clockwise and then counter-clockwise. The movement in moving between FIGS. 5 and 6 somewhat resembles the movement of a snakes body as the snake slithers across a surface.

The neck 78 is made up of a series of links which are arranged in a linear sequence. In moving from the body 12 toward the head 118 the links are arranged in a row starting from link 120 which is attached to link 121 which in turn is attached to link 122, which in turn is attached to link 123, which in turn is attached to link 124, which in turn is attached to link 125, which in turn is attached to link 126. The head 118 then attaches to link 126.

Link 120 is fixed to the body 12 by connecting it to the neck foundation member 104 via frictionly fitting a rounded tongue 128 on link 120 into a groove (not separately shown or numbered) formed on the neck foundation member 104. This fixly attaches the link 120 to the neck foundation member 104. As the neck foundation member 104 pivots about its axle 106 to the left and to the right, this motion is transferred to link 120 which in turns transfers it to the remainder of the links to move the neck 78 and the head 118 from side to side in a sweeping motion.

Link 120 has an axle 130 which fits into a bearing 132 formed on link 121. This pivotally or rotatably connects link 121 to link 120. A similar axle and bearing combination is utilized to pivotally attach link 122 to link 121, and as such, like numbers are utilized to identify these axle and bearing connectors. The same is true in attaching link 123 to link 122, link 124 to 123, link 125 to link 124, and link 126 to link 125, again the like numerals 130 and 132 are used to identifing these connectors or joints. Press-on rubber caps, collectively identified by the numeral 134, are utilized to secure the axles 130 in the bearings 132 after appropriately attaching each link in the sequence. These connectors are shown in FIG. 1 and are further utilized for connecting other moveable body parts of the toy 10 to each other as well as being utilized for decorative purposes elsewhere in the toy 10.

As so connected, the first and last links, i.e. link 120 and 126 are each pivotally mounted to one further link, i.e. links 121 and 125, respectively. The interior links, links 121, 122, 123, 124 and 125 are each connected to two links, one on either side, as for instance link 122 pivotally connected to both link 121 and to link 123. The order of the links is thus always maintained, however, the linear sequence of links is free to articulate about the axle and bearing connecting means formed by the axles 130 and the bearings 132.

In addition to the axle and bearings 130 and 132 serving as means to join each link to its immediate neighbor in a linear sequence, the links are further connected such that movement of any one link with respect to its immediate adjacent neighbor is transmitted to the remainder of the links. This further connections which transfers motion between the links, consists of joining link 121 to link 123, joining link 123 to link 125, joining link 120 to link 122, joining link 122 to link 124 and joining link 124 to link 126. This is accomplished utilizing a first type of connecting means for most of the connections and a second type for the remaining connections.

Figure 6:
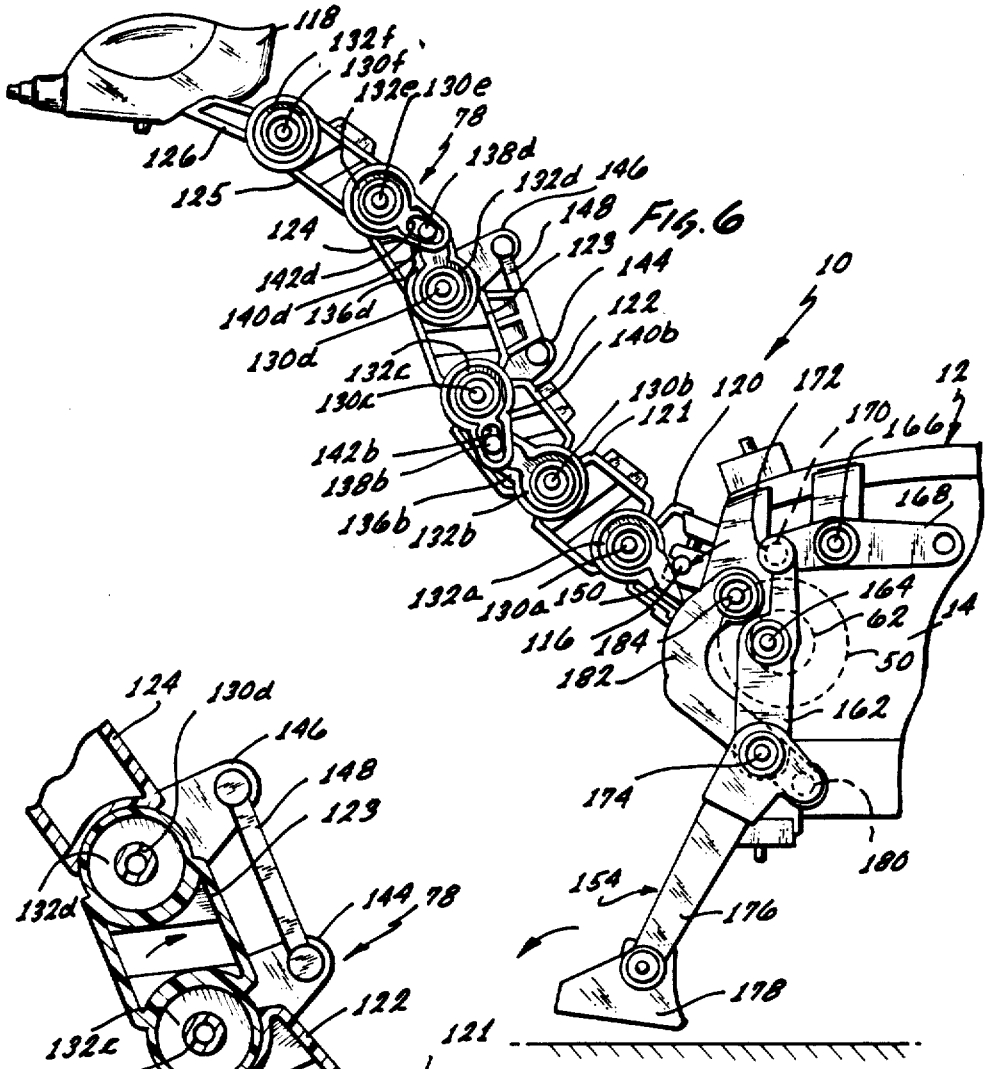
FIG. 6 is a view similar to FIG. 5 except certain of the components of the toy are shown in a second spatial configuration.
Figure 7:
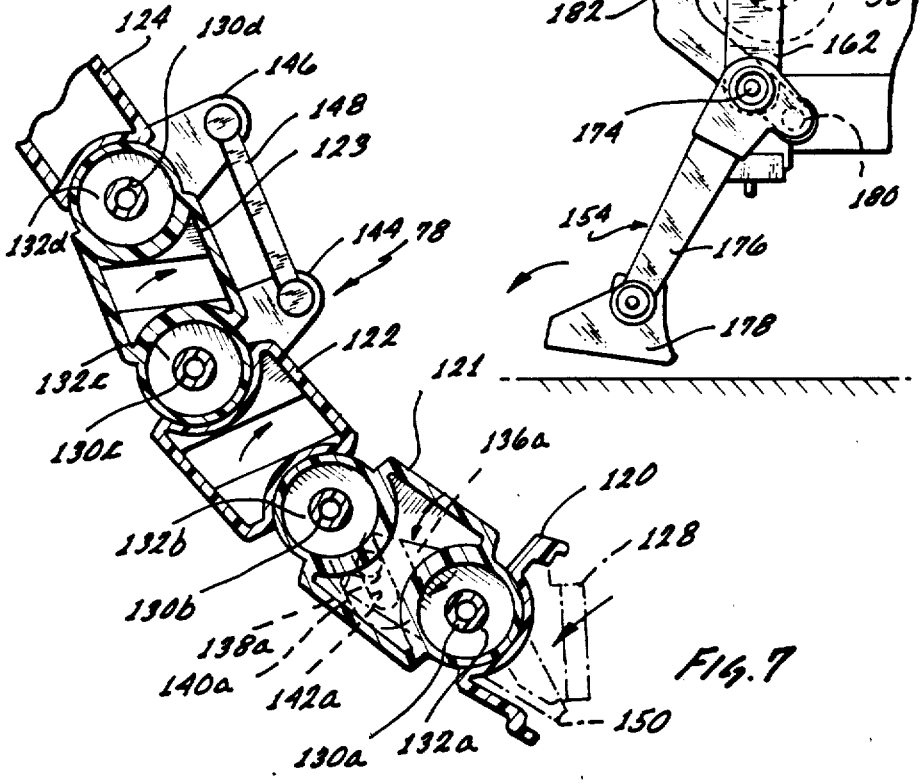
FIG. 7 is an elevational view in section of certain of the components seen in FIG. 6.

The first type of connection is achieved using an arm 136, having a small boss 138 thereon which projects from one of the axle 130 and bearing 132 joints to a further arm 140 having a slot 142 formed therein. The arm 140 projects from another of the axle 130 bearings 132 joints. This is seen in FIG. 6 wherein the arm 136-*b* formed on link 121 connects to the arm 140-*b* formed on link 123. The boss 138 on arm 136-*b* moves in the slot 142 of arm 140-*b* such that movement of the link 121 about the axle 130-*b*, this is movement of link 121 with respect to link 122, is communicated to link 123 such that link 123 pivots about axle 130-*c* and in doing so moves with respect to link 122. This manner of communicating motion between the links is utilized to associate link 120 to link 122, link 121 to link 123, link 123 to 125, and link 124 to link 126.

Link 122 is joined to link 124 utilizing a similar principle of joining, however, instead of directly joining arms 136 and 140, an arm 144 on link 122 is indirectly joined to an arm 146 on link 124 by a connector 148. While the arms 136 and 140 are essentially along the connecting pathway of the axle and bearings 130 and 132 connecting all the links together, the arms 144 and 146 projects perpendicular to this connecting pathway such that the connector 148 will be parallel to a line passing through the axles 130-*c* and 130-*d* which join link 122 to link 123, and link 123 to link 124, respectively.

The in line connector arms 136 and 140 causes the links in the linear sequence to articulate in smooth curves forming the clockwise curve in the bottom of the neck 78 seen in FIG. 6 and the counter-clockwise curve in the top of the neck seen in FIG. 6. The arms 144 and 146 in conjunction with the connector 148 reverses the curvature such that there is both a clockwise and counter-clockwise curve in the neck 78 when it is both raised as seen in FIG. 6 and when it is lowered as seen in FIG. 5.

A further type of connector is formed on link 121 which interacts with the transfer member 108 to cause articulation of the neck 78. An activation arm 150 formed on link 121 projects from the bearing and axle 132-*a* and 130-*a* connecting links 120 to 121 back along the side of link 120 to a position next to the transfer member 108. The small boss 116 formed on the transfer member 108 is located over the top of the articulation arm 150. In response to movement of the transfer member 108 caused by movement of the member 100, the boss 116 pushes down onto the activation arm 150 to articulate the neck 78 and raise it to the position seen in FIG. 6. When the transfer member 108 rotates upwardly in response to downward movement of the member 100 the boss 116 also moves upwardly. This allows the weight of the neck 78 under the influence of gravity to lower the neck 78 to the position seen in FIG. 5.

As the neck 78 moves downwardly, the links concurrently articulates with respect to one another going from the configuration shown in FIG. 5 to a straight line and then into the configuration shown in FIG. 6. Thus, gravity is utilized to lower the neck to position 5 with movement of the links with respect to one another causing the confirmational change shown in FIG. 5 and then pressure of the transfer member 108 on the articulation arm 150 raises the neck 78 to the confirmation seen in FIG. 6.

It is evident that if all of the links were joined via arms 136 and 140 the neck 78 would articulate in a smooth continuous curves, but by introducing the arms 144 and 146 in conjunction with the connector 148 a double curve is achieved upon articulation. For the purpose of the illustrative embodiment, link 120 is shown being fixed to the shell 14 with movement of the activation arm 150 on link 121 causing articulation of the neck 78. It is evident that this could be reversed with the articulation arm 150 being held fixed and movement imparted to link 120 to articulate the neck 78. The articulation of the neck 78 is achieved as long as each link is pivotally connected to its adjacent neighbor as per instance on A link, link 120, being pivotally connected to a B, link 121, which in turn is pivotally connected to a C, link 122, which is pivotally connected to a D, link 123. Further, every other link is associated to transfer motion from every other link as per instance link 120 being associated with link 122, i.e. the A link being associated with the C link, and link 121 being associated with the link 123, i.e. the B link being associated with the D link. The type of association doesn't matter. It can be a direct in line association such as that with the arms 136 and 140, or the indirect association such as with the arms 144 and 146 and connector 148.

The body 12 is supported by four legs, left front leg 154, right front leg 156, left rear leg 158, and right rear leg 160. Aside from their placement so as to form an essential quadralateral base for the toy 10 and aside from their a symmetry between left and right and front and back, the components making up each of the legs 154, 156, 158 and 160 are identical in operation. As such only the individual components of the left front leg 154 will be described in detail, it being understood that the other three remaining legs 156, 158 and 160 contain similar components attached in identical manners.

The leg 154 includes a first essentially vertically oriented member 162 which in essence is a first class lever. The member 162 includes a bearing 164 which fits over crank pin 66 and connects the member 162 to the crank pin 66 on the left front crank disc 62. The member 162 thus will be moved by the crank pin 66 as the crank pin 66 rotates in response to rotation of the crank disc 62. The member 162 is maintained on the crank pin 66 with one of the connectors 134.

A boss 166 is formed on the shell 14. A second member 168 also formed as a first class lever is pivotally mounted about the boss 166. The second member 168 includes a boss 170 on its forward most end which fits into a hollow cap 172 formed on the upper end of the member 162. This pivotally connects the member 162 to the second member 168. The member 168 is free to pivot about the boss 170 upwardly and downwardly much like a teeter-tooter. Because of the connection between the boss 170 and the cap 172, connecting the member 162 to member 168, travel of the upper end of the member 162 is limited to an arcuate pathway governed by the travel of the end of the member 168. The lower end of the first member 162 includes a boss 174. Because of the limited travel imposed by the upper end via the connection of the second member 168, the lower end including the boss 174 of the first member 162 moves in an orbit.

A third member 176 includes a bearing which attaches to the boss 174 connecting the third member 176 to the lower end of the first member 162. One of the connectors 134 is utilized to fix the third member 176 of the first member 162. A foot 178 is pivotally connected to the bottom of the third member 176 via a boss and bearing connection not numbered or shown similarly to the other connectors between the members 162, 168 and 176. It further includes one of the connectors 134 to maintain the foot 178 positioned on the bottom of third member 176. The foot 178 can pivot through a few degrees of freedom because of this method of connecting allowing its bottom to fit flush against a support surface whether the member 176 as seen in FIG. 5 is either in the rearward position shown in solid line, or in the forward position shown in phantom line.

The third member 176 is formed as a bell crank having two arms which essentially join at the junction wherein the boss 174 of the first member 162 connects to it. It includes a longer arm, which forms the shin or lower leg portion of the member 176, and a short arm which projects backwardly horizontally and includes a boss 180 located thereon. The boss 180 is pivotally connected to a fourth member 182 with the fourth member being curved such that it projects foward underneath the first member 162 and attaches to a boss 184 which is also formed on the shell 14. The boss 184 is positioned forward of the upper end of the first member 162.

As the lower end of the first member 162 orbits, starting from the position shown in solid line in FIG. 5, the junction portion of the third member 176 is lifted upwardly. The connection between the boss 180 on the end of the short arm and the fourth member 182 however causes the third member 176 to rotate about boss 180 bringing the third member 176 forward to the position shown in phantom line in FIG. 5, or the position shown in solid in FIG. 6. This brings the lower part of the leg 154 and the foot 178 forward in a stepping like motion. When the crank pin 66 has essentially reached the ten o'clock position moving counter-clockwise, the foot 174 is at its forward most position of travel. Further counter-clockwise rotation of the crank pin 66 straightens the third member 176 with respect to the first member 162, again because of rotation about the boss 180 and as the crank pin 66 moves from about the nine o'clock position to the six o'clock position the third member 176 is brought back bringing the foot 178 backward producing forward thrust on the toy 10 until about the three o'clock position is reached. At the three o'clock position the third member 176 and the foot 178 are lifted upwardly from the support surface to once again start the orbit wherein they are lifted upward, pushed forward, brought down and pulled backward in a walking like manner.

Because the crank pin 66 on the left front leg 154 is 180° out of phase from the crank pin 68 on the right front leg 156, as the left front leg 154 is going forward, the right front leg 156 is going backwards. Further, because the crank pin 66 on the left front leg 154 is 180° out of phase from the crank pin 74 on the left rear leg 158, as the left front leg 154 is going forward, the left rear leg 158 is going backwards. This produces a motion wherein the left front leg 154 and the right rear leg 160 are moving forward and backwards in unison and the right front leg 156 and left rear leg 158 are moving forward and backward in unison. Because of this the toy 10 moves with a walking like motion characteristic of the movement of a typical four-legged animal.

The toy 10 also includes a tail 186 which projects backwardly from the shell 14 of the body 12. The tail 186 serves as a counter balance to the neck 78 to maintain the toy in an appropriate level position irrespectively of the simultaneous movement of the legs 154, 156, 158 and 160, and the neck 78 both side to side and as it articulates up and down through its compound curves. Additionally, for appearance sake only, the link 188 shown on the left side in FIG. 1, connects the rear of the second member 168 on the left front leg 154 to the top of the first member 162 on the left rear leg 158. The connector 188 has a slot 190 allowing for slidding of connector 188 on an appropriate boss on the upper portion of the first member 162. This is totally cosmetic in nature and does not contribute or interfer with the above described movement of the appropriate legs. Likewise, a similar connector not shown or numbered is located on the right hand side of the toy 10. The second members 168 of both of the right front legs 154 and 156 do not need to be extended beyond their pivot point to accommodate the connector 188. The member 168 could terminate at a bearing surface around a pivot point and the connector 188 would not be utilized.

In the illustrated embodiment, the neck 78 includes 7 links connected together by 6 axle and bearing means 130 and 132, and 5 motion transfer means, arms 138 and 140, plus arms 144 and 146 with their connector 148. Thus, there are n number of links, n minus 1 number of connecting means and n minus two number of motion transfer means. This is not counting the activation arm 150.

I claim:

1. An articulated linkage which comprises:

at least a first link, a second link, a third link and a fourth link pivotally connected to together in a linear array, said second link located between said first and said third link, said third link located between said second and said fourth link;

a plurality of joining means equal to the number of said links minus one, a first of said joining means pivotally connecting said first link to said second link, a second of said joining means pivotally connecting said second link to said third link, a third of said joining means pivotally connecting said third link to said fourth link;

each of said first, said second, said third and said fourth links having an arm member fixedly attached to said respective first, second, third, and fourth links;

said first arm member projecting from said first link across a portion of said second link towards said third link;

said third arm member projecting from said third link across a portion of said second link towards said first link;

said second arm member projecting from said second link across a portion of said third link towards said fourth link;

said fourth arm member projecting from said fourth link across a portion of said third link towards said second link;

a boss on said first arm member;

a slot in said third arm member;

said boss on said first arm member fitting in said slot on said third arm member to operatively connect said first arm member and said third arm member;

a boss on said second arm member;

a slot on said fourth arm member;

said boss on said second arm member fitting in said slot on said fourth arm member to operatively connect said second arm member and said fourth arm member.

2. A linkage for a moveable toy having a body and a motor located in said body, said linkage comprising:

a crank operatively associated with said motor so as to be rotated by said motor, said crank including a crank pin which moves in a circular pathway in response to rotation of said crank;

a first member having ends and including connecting means located distal from said ends between said ends, said first member pivotally mounted on said crank pin about said connecting means;

a second member having at least one end and a second member connecting means, said second member pivotally mounted to said body about said second member connecting means, said at least one end of said second member pivotally connecting to one of the ends of said first member whereby rotation of said crank is transferred to said first member to move said first member and in turn said first member rotating said second member about said second member connecting means;

a third member, said third member pivotally connecting to the other of said ends of said first member so as to pivot with respect to said first member;

limit means associated with said third member for limiting the pivotal motion of said third member with respect to said first member between a first limit and a second limit.

3. The linkage of claim 2 wherein:

said limit means comprises a fourth member, said fourth member including first and second fourth member connecting means, said fourth member pivotally connected to said third member and said body about said first and second fourth member connection means, respectively.

4. The linkage of claim 3 wherein:

said third member is formed as a bell crank having first and second arms joined together at a junction, said fourth member pivotably connected to said bell crank at the end of one of said arms of said bell crank, said bell crank pivotably connecting to the other of said ends of said first member at the junction of said arms of said bell crank.

5. The linkage of claim 4 including:

four of said linkages attaching to said body, each of said linkages including a first member which is essentially vertically oriented with respect to said body with said second member located near the upper end of said first member and said third member located near the lower end of said first member.

6. A movable appendage for a toy having a body and a motor located in said body which comprises:

a crank operatively associated with said motor so as to be rotated by said motor, said crank including a crank pin, said crank pin moving in a circular pathway in resonse to rotation of said crank;

an upper appendage element, said upper appendage element having ends and including a bearing located between said ends, said bearing fitting on said crank pin to pivotally connect said upper appendage element to said crank;

an additional appendage element pivotally connecting to a first of said ends of said upper appendage element and pivotally connecting to said body, said additional appendage element movably operatively connecting said first of said ends of said upper appendage element to said body;

a lower appendage element, said lower appendage element having ends, a first of said ends of said lower appendage element pivotally connected to a second of said ends of said upper appendage element;

A further appendage element, said further appendage element pivotally connected to said lower appendage element and movably operatively connected to said body.

* * * * *

UNITED STATES PATENT AND TRADEMARK OFFICE

CERTIFICATE OF CORRECTION

PATENT NO. : 4,680,022

DATED : JULY 14, 1987

INVENTOR(S) : SHIRO HOSHINO, BONPEI FUJINO

It is certified that error appears in the above-identified patent and that said Letters Patent is hereby corrected as shown below:

Column 1, line 15, delete "Just",

Column 1, line 20, "seemly" should be --seemingly--,

Column 1, line 50, "muscles" should be --Muscles--,

Column 2, line 12, "rotatability" should be --rotatably--,

Column 2, line 56, "is to" should be --is--,

Column 2, line 60, "link from" should be --links from--,

Column 3, line 8, "advantageous" should be --advantageously--,

Column 3, line 11, "mimicks" should be --mimics--,

Column 3, line 19, "a upper" should be --an upper--,

Column 4, line 2, "a animal" should be --an animal--,

Column 4, line 7, "crown 20" should be --crown gear 20--,

Column 4, line 35, "toward to" should be --toward--,

Column 4, line 46, "fixly" should be --fixedly--,

Column 6, line 48, "turns" should be --turn--,

Column 6, line 57, "124 to 123" should be --124 to link 23--,

UNITED STATES PATENT AND TRADEMARK OFFICE

CERTIFICATE OF CORRECTION

PATENT NO. : 4,680,022

DATED : JULY 14, 1987

INVENTOR(S) : SHIRO HOSHINO, BONPEI FUJINO

It is certified that error appears in the above-identified patent and that said Letters Patent is hereby corrected as shown below:

Column 6, line 59, "identifing" should be --identify--,

Column 7, line 10, "as means" should be --as connecting ıeans--,

Column 7, line 14, "This" should be --The--,

Column 7, line 24, "132 joints to a" should be --132. The ıoss 138 connected to a--, Column 7, line 35, "123 to 125" should be --123 to line 25--, Column 9, line 17, "176 of" should be --176 to--, Column 10, line 27, "slidding" should be --sliding--, Column 10, line 30, "contribute or" should be --contribute ıo or--, Column 10, line 47, "I Claim" should be --We Claim--, Column 10, line 51, "to together" should be --together--, Column 12, line 44, "A" should be --a--.

Signed and Sealed this

Fifth Day of July, 1988

*Attest:*

DONALD J. QUIGG

*Attesting Officer*

*Commissioner of Patents and Trademarks*